US005267838A

United States Patent [19]

Baugh

[11] Patent Number: 5,267,838

[45] Date of Patent: Dec. 7, 1993

[54] SEVERE SERVICE COMPRESSOR SYSTEM

[76] Inventor: Benton F. Baugh, 14626 Oak Bend, Houston, Tex. 77079

[21] Appl. No.: 816,711

[22] Filed: Jan. 3, 1992

[51] Int. Cl.[5] ..... F04B 3/00

[52] U.S. Cl. ..... 417/244; 417/392; 417/347; 92/162 R; 277/53

[58] Field of Search ..... 417/244, 254, 390, 392, 417/344, 345, 346, 347; 277/53, 55, 138, 216, 217; 92/162 R

[56] References Cited

U.S. PATENT DOCUMENTS

| | | | |
|---|---|---|---|
| 781,266 | 1/1905 | Bryan et al. | 277/53 |
| 2,644,401 | 7/1953 | Ragland | 417/394 |
| 2,932,172 | 4/1960 | Schlumbohm | 417/392 |
| 3,244,106 | 4/1966 | Guy | 417/244 |
| 4,629,200 | 12/1986 | Ruddy | 277/216 |
| 5,092,743 | 3/1992 | Dietrich | 417/392 |

*Primary Examiner*—Richard Bertsch
*Assistant Examiner*—Charles G. Freay

[57] ABSTRACT

A severe service compressor for the reliable compression of dirty gasses using compressors with seals cooled by the hydraulic fluids doing the work of compression and seals isolated from the high temperatures of the compressed gasses by piston rings which restrict the flow of compressed gasses into the area adjacent to the seals on the compresion stroke and allow the venting of the gasses adjacent to the seals on the reverse stroke.

7 Claims, 2 Drawing Sheets

SEVERE SERVICE COMPRESSOR SYSTEM

BACKGROUND OF THE INVENTION

The field of this invention is that of compressing relatively dirty gases in severe service situations involving high pressures and/or high temperatures. Such gases occur when attempting to compress exhaust gases for oil well service operations, such as is described in U.S. Pat. No. 4,811,558 titled System and Method for Providing Compressed Gas.

The above mentioned patent is directed toward compressing diesel engine exhaust gas, however, the improvements in this patent will also apply to the need for compressing other cleaner gases at high temperatures or high pressures.

Historically oilfield service operations have primarily been performed using nitrogen gas. It is an extremely clean gas, but is available only in a cryogenic liquid form (−273 degrees F.) and is expensive to buy, transport, pump, and use. The substantial cost reductions available using exhaust gases for service work make them an attractive alternative.

Uses of exhaust gas taken at ambient pressure directly from the exhaust pipe of an engine provide the capability of using conventional scrubbers to clean the gas, however, the cost of compression of the gas from ambient to 5,000 or 10,000 p.s.i. makes the system as expensive as cryogenic nitrogen. It is as large as a cryogenic nitrogen system.

The patent referred to above draws exhaust gas directly from the cylinder head at 600–800 p.s.i. allowing for much smaller and less expensive secondary compression to higher pressures, but provides a "dirty" gas.

SUMMARY OF THE INVENTION

The object of this invention is to provide a reliable compression means for compressing dirty gases.

A second object of the present invention is to provide sealing for a compression system which is tolerant to high compression temperatures.

A third object of the present invention is to provide a compressor whose seals are aided in tolerance to compression temperatures by virtue of being cooled by a flow of cooled hydraulic fluid.

Another object of the present invention is to provide a compressor whose seals are aided in tolerance to compression temperatures by virtue of the rate of compression of the gases adjacent to the seal being retarded.

Another object of the present invention is to provide a severe service compressor suitable for use in parallel with a second compressor and allow continuous use of a supply of hydraulic fluid.

Another object of the present invention is to provide such severe service compressors in series to accomplish high pressure compression by stages.

DESCRIPTION OF THE PREFERRED EMBODIMENT

Figure 1:
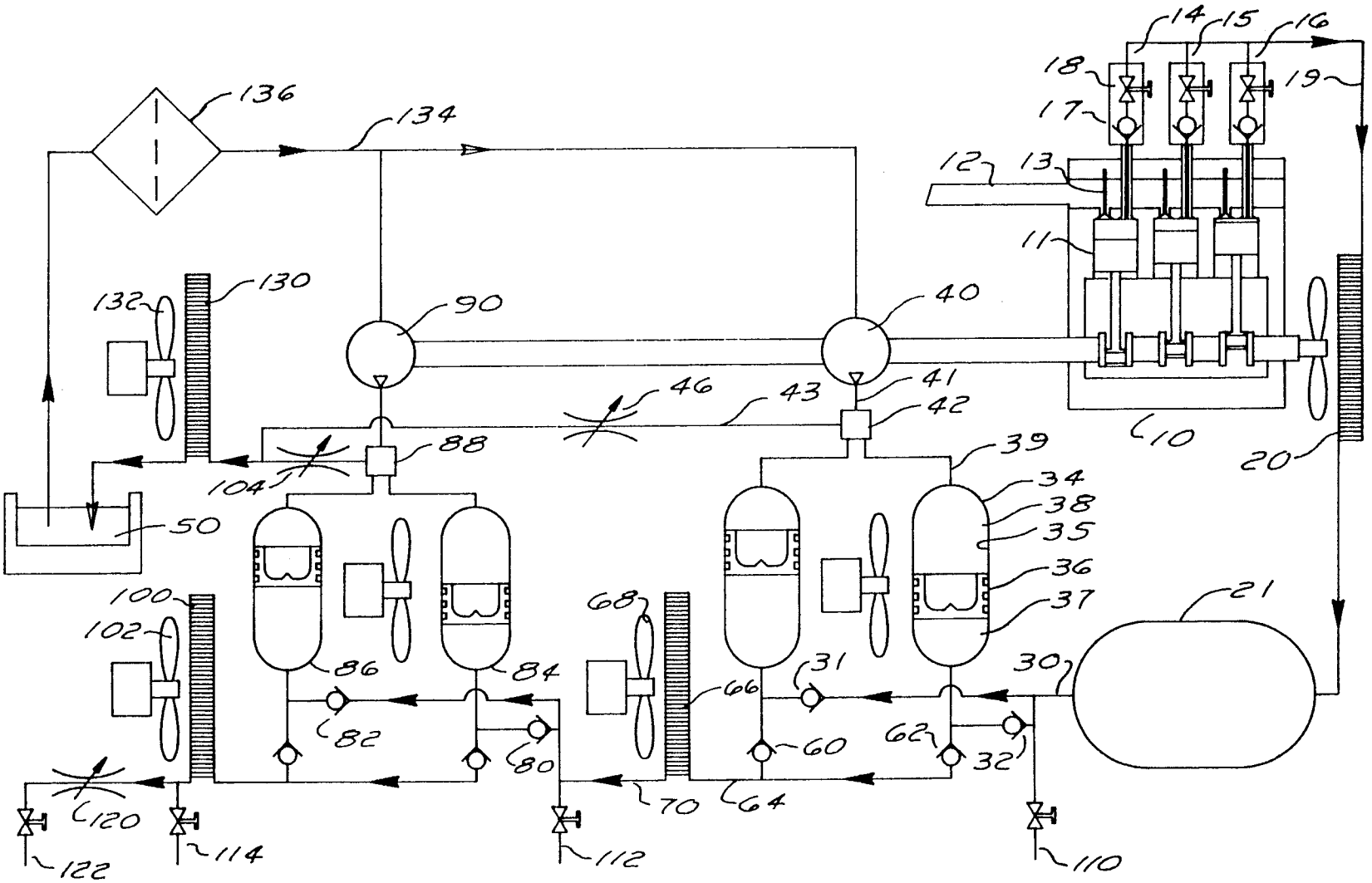
FIG. 1 is a schematic view of a system employing the compression means of this invention.

Referring now to FIG. 1, diesel engine 10 has pistons 11, exhaust pipe 12, exhaust valves 13, and extractor valve assemblies 14, 15, and 16. Extractor valve assembly 14 shows check valve portion 17 and shutoff valve portion 18. Line 19 collects the output from extractor valve assemblies 14, 15, and 16, directs it past a cooling radiator 20 and to receiver 21.

Pressure in receiver 21 is kept at 600–800 p.s.i., which is high enough to prevent gas from passing thru check valves 17 before ignition on the diesel engine 10. Such ignition usually takes place at pressures below 525 p.s.i. Once ignition occurs within each cylinder of the diesel engine and cylinder head pressures increase to as much as 2400 p.s.i., a portion of the exhaust gas is siphoned off thru the extractor valve assemblies and to the receiver 21.

In a diesel engine such as a Detroit Diesel 12V92TA, as much as 60,000 SCFH (standard cubic feet per hour) can be produced to the receiver 21. At this point the gas will be cooled down to the range of 140 degrees F., but is still dirty. It will contain some hard carbon particles and water, each of which are detrimental to the life of any compressor.

Line 30 and check valves 31 and 32 lead to compressors 33 and 34, respectively. As the two compressors are identical in function, only compressor 34 will be described in detail. Compressor 34 has a bore 35 and a piston 36 slidably mounted in bore 35. Chamber 37 contains exhaust gas being compressed. Chamber 38 contains hydraulic oil doing the compressing of the gas. Hydraulic line 39 provides for input and withdrawal of hydraulic fluid from the chamber 37.

Pump 40 provides a continuous supply of hydraulic fluid thru line 41 to a control valve 42. In a first mode, control valve 42 provides hydraulic supply to compressor 34 to compress the gas within chamber 37. When the piston 36 reaches the end of its stroke, the pressure within chamber 38 will exceed its limits, i.e. 1750 p.s.i., and cause the control valve 42 to switch to a second mode. In the second mode, the control valve 42 will vent the fluid in chamber 38 thru line 39 and line 43 back to the reservoir 50. In route to the reservoir 50, the fluid will pass thru a flow restrictor valve 46 which will not allow the pressure in chamber 38 and therefore in chamber 37 to fall below a minimum amount, i.e. 500 p.s.i. Pressure from receiver 21 will provide the force to drive the piston 36 up to its upper stop.

While piston 36 is making its return stroke up, the compressor 33 will be in its first mode of compression. Also, while compressor 34 is in its first mode of compression, compressor 33 will be in its return mode. By this method, the flow of hydraulic fluid from pump 40 can be continuously used to promote compression of gases from receiver 21. Compressors 33 and 34, in combination with control valve 42 and pump 40 work together to form a first stage of compression of the collected gases. The compressed gases from compressors 33 and 34 are collected thru check valves 60 and 62 are collected into line 64 and pass thru cooler 66. Fan 68 blows across cooler 66 to cool the gases from their elevated temperature of compression, i.e. 400 degrees F. back down to a lower temperature, i.e. 140 degrees F. Cooled gases are delivered along line 70 thru check valves 80 and 82 to compressors 84 and 86 respectively. Compressors 84 and 86, control valve 88, and pump 90 make up the primary components of the second stage of compression and act in the same way compressors 33 and 34, control valve 42, and pump 40 did in the first stage of compression did. The second stage of compression can elevate the pressure of the gases up to a higher level, i.e. 5000 p.s.i. and cooler 100 with fan 102 can bring the temperature of compression, i.e. 400 degrees F., back down to a lower level, i.e. 140 degrees F. Flow restrictor valve 104 acts similarly to flow restrictor valve 46. Alternately, this flow restriction function can be replaced by returning the pressured fluid to the inlet port of the pumps and increasing the efficiency of the pumping arrangement. At this point, the gaseous production from this system can be drawn off at valve 110 at 600–800 p.s.i., at valve 112 at 1750 p.s.i., or at valve 114 at 5000 p.s.i. Each of these locations can have a temperature in the range of 140 degrees F.

Flow restrictor 120 can be placed in the line to reduce the pressure of the gases down to a lower level, i.e. 100 p.s.i., causing the gases to theoretically be reduced to −250 degrees F. temperature at valve 122. Such a reduction in pressure would provide the equivalent to almost 40 tons of air conditioning of cooling capacity. This allows the unit to provide a substantial cooling capacity in addition to its primary function of providing a supply of high pressure working gas. This is expected to be beneficial in the cooling of drilling mud in geothermal well drilling where effective cooling of the drilling mud can increase the depth of the well which can be drilled with drilling mud before the mud begins to boil. After this type process provides cooling for the drilling mud, the compressed diesel exhaust gas can provide the flow for air drilling, without the conventional problems with downhole fires from normal air.

Cooler 130 with fan 132 is added in the circuit with the hydraulic fluid to cool the hydraulic fluid, some additional advantages of this being seen in association with the next figure. Line 134 is the suction line to supply the pumps 40 and 90. Normal filters such as 136 would be installed on this line to promote long service life from the pumps.

Figure 2:
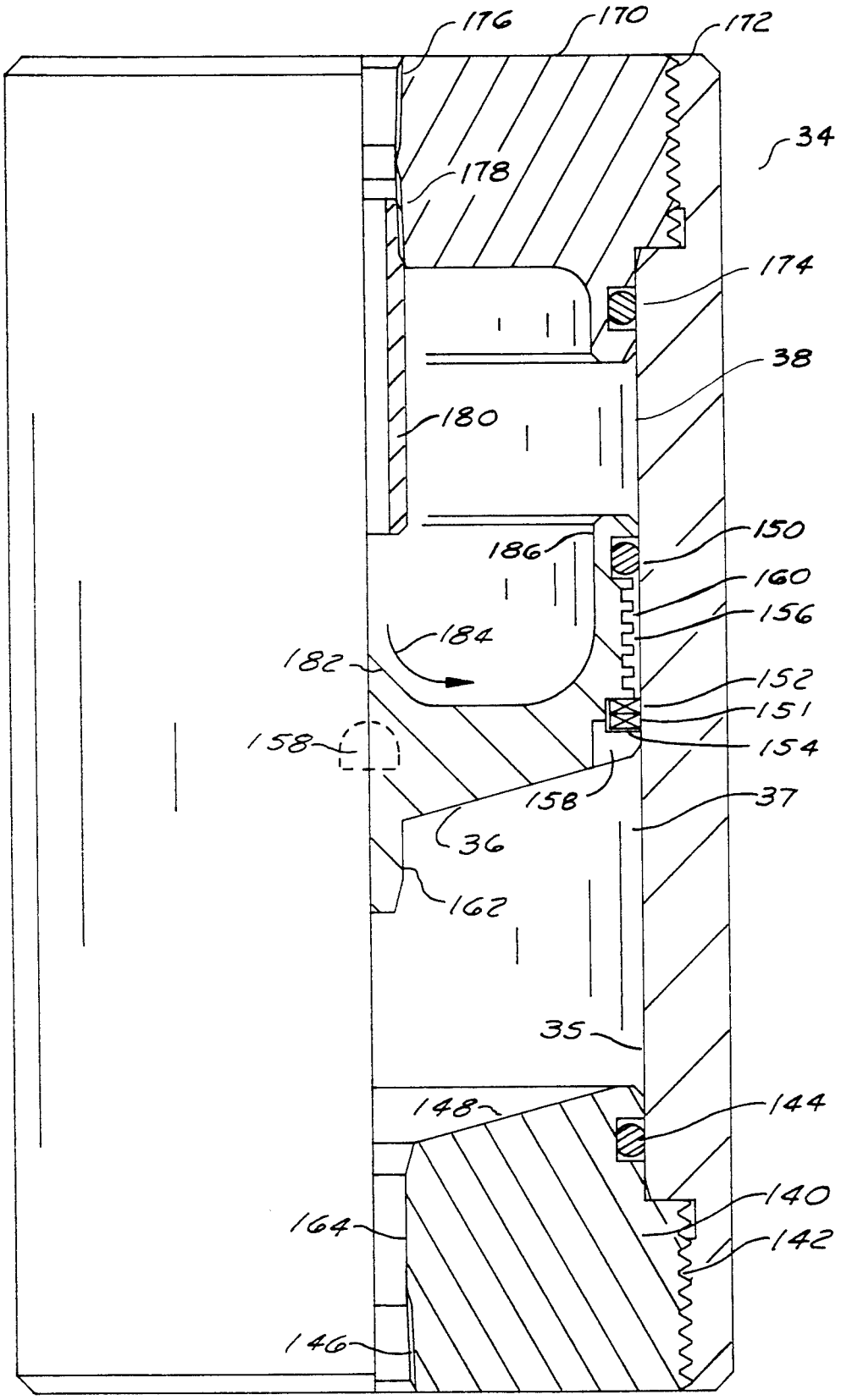
FIG. 2 is a quarter section of a compressor using the principles of this invention.

Referring now to FIG. 2, compressor 34 is shown in greater detail. It is of similar construction to the compressor 33, 84, and 86. Compressor 34 has a bore 35 and a piston 36. Lower end cap 140 has a connecting thread 142 and a seal ring 144 for sealing with bore 35. Lower pipe thread connection 146 is suitable for connecting the line 30 as indicated in FIG. 1. Surface 148 is sloped to assist any foreign particles or condensed liquid in the gas stream to be flushed out of the cylinder with each cycle of the piston.

Piston 36 has an upper piston seal 150 of a resilient type for sealingly engaging the bore 35 to isolate the gases below from the hydraulic fluid above. As the piston is moved down by hydraulic fluid flowing down into chamber and the gas in chamber 37 is compressed, the temperature will quickly reach temperature levels of 400 degrees F. This temperature is above the working range of many resilient seals, and the seals designed to work in ranges such as this will have shortened lives if continuously operated at such high temperatures. For this reason piston rings 151 and 152 are installed in a groove 154 in the piston 36. These piston rings can be made of a soft material such as bronze so that they will not mar the walls of the harder steel cylinders, but will serve the function of restricting the flow of gases into the intermediate area 156 between the piston rings 151 and 152 and the upper piston seal 150. They seal with the bore as piston rings do in a diesel engine, however, as they are sliding metal on metal and have gaps at their ends they will leak slightly. This is herein being referred to as partial sealing.

Conversely, when the piston 36 begins and upward stroke for recharging the chamber 37 with gas, the piston rings 151 and 152 will move to the bottom side of groove 154 and slots 158 will quickly vent any pressure buildup in the intermediate area 156, affording some cooling to this area. Grooves 160 can be added to increase the volume of this area to slow the pressure buildup, and can also provide additional surface area for heat transfer to the bore.

Nose 162 will extend into bore 164 when the piston approaches the end of its stroke and act to cushion the movement of the piston as it approaches the end of its stroke.

Upper end cap 170 has a connecting thread 172 and a seal ring 174 for sealing with bore 35. Upper pipe thread connection 176 is suitable for connecting the line 39 as indicated in FIG. No. 1. A second pipe thread 178 has a short pipe stub 180 for directing the flow of hydraulic fluid downwardly. The flow impinges a conical shape 182 on the piston 36 and uniformly spreads the flow 184 out and upward past surface 186 on piston 36. This flow of hydraulic fluid which has been cooled by cooler 130 in FIG. 1 provides a cooling effect on the area of the piston 36 which contains upper piston seal 150. The resultant cooling effect on this seal will extend the reliable service life of the seal.

Additionally upper piston seal 150 sees little differential pressure for sealing and causing wear, even when compressing the gas to pressures of 5000 p.s.i. Instead of a 5000 p.s.i. differential across the seal when compressing to 5000 p.s.i., upper piston seal 150 will see only a low pressure differential (i.e. 500 p.s.i. or 10% or less) which is caused by the partial sealing of the piston rings 151 and 152 to prevent heat buildup.

Therefore the reliable seal life of upper piston seal 150 will be extended by providing a cooler environment, providing a very low sealing differential, and by keeping any particles in the gases away from the seal.

The foregoing disclosure and description of this invention are illustrative and explanatory thereof, and various changes in the size, shape, and materials as well as the details of the illustrated construction may be made without departing from the spirit of the invention.

I claim:

1. Apparatus for the compression of gases by means comprising a piston travelling within a cylinder and having a bore and having valving means for inlet and exhaust of said gases, wherein said exhaust valving means being connected to said cylinder at an elevation lower than said piston, such that any liquid or solid matter within the gases will be moved to the lower end of said cylinder and will be exhausted from said cylinder when said exhaust valving means is opened, and wherein said piston divides said cylinder into a first chamber and a second chamber, and further comprising a fluid and a fluid pumping means to pump said fluid under pressure into said first chamber to move said piston toward said second chamber, said piston further comprising one or more seals to seal with the bore of said cylinder and an inner surface proximate to said one or more seals, wherein said fluid flows across said inner surface of said piston proximate to said one or more seals on said piston and provides cooling for said one or more seals.

2. Apparatus for compressing gases comprising a cylinder having a bore, a piston for traveling in said bore and which is powered by a fluid, said piston having a length along the axis of said bore, said fluid being on a first side of said piston and said gas to be compressed on a second side, said piston dividing said bore in said cylinder into a first section for said fluid and a second section for said gases to be compressed, a seal ring sealingly mounted on said piston and which sealingly engages said bore, said seal ring being mounted proximate said first side, one or more piston rings for mounting on said piston which provide a partial seal between said piston and said bore, said one or more piston rings being mounted proximate said second side, an intermediate area between said one or more piston rings and said seal ring having a volume, such that when said piston is moved by said fluid to compress said gases, increases in the temperature of the gases due to compression in said intermediate area is limited in comparison to the increases in the temperature of the gases remaining in said second side both by reduction of the amount of gas which enters said intermediate area and by cooling effect of the surface area intermediate area, wherein said one or more piston rings are mounted in a groove, said apparatus having a first relationship of said one or more piston rings, said groove, and said bore providing a partial sealing engagement in a first direction of flow from said second side to said intermediate area, and said apparatus having a second relationship of said one or more piston rings, said groove, and said bore preventing a sealing engagement in a second direction from said intermediate area to said second side.

3. The invention of claim 2, wherein said second section of said cylinder for compression has valving means which are mounted in a position lower than said piston.

4. The invention of claim 3, wherein said valving means are check valves.

5. The invention of claim 2, wherein said second section of said cylinder for compression has porting for said valving means, and said porting for said valving means enters said cylinder at a location lower than said piston.

6. The invention of claim 2, wherein said piston further comprising an inner surface proximate to said one or more seals, and said fluid flows across aid inner surface of said piston proximate to said seal ring on said piston and provides cooling for said seal ring.

7. An apparatus for compressing gases comprising a cylinder having a power fluid in a first chamber, and gases for compression in a second chamber, first porting for directing flow of power fluid into and out of said first chamber, and second porting for directing flow of gases into and out of said second chamber, wherein wherein said cylinder has a bore, a piston with a recess and with one or more seals sealing with said bore divides said first chamber from said second chamber, and wherein said fluid flows across said piston recess proximate to said one or more seals on said piston and provides cooling for said one or more seals.

* * * * *